US009856725B2

(12) United States Patent
Stehle et al.

(10) Patent No.: US 9,856,725 B2
(45) Date of Patent: Jan. 2, 2018

(54) DEVICE AND METHOD FOR WELL STIMULATION

(71) Applicant: Elektro-Thermit GmbH & Co. KG, Halle (DE)

(72) Inventors: Vladimir Stehle, Kassel (DE); Konrad Siemer, Kassel (DE); Jan Hantusch, Markkleeberg (DE); Werner Angenendt, Halle/Saale (DE)

(73) Assignee: ELEKTRO-THERMIT GMBH & CO. KG, Halle (DE)

( * ) Notice: Subject to any disclaimer, the term of this patent is extended or adjusted under 35 U.S.C. 154(b) by 308 days.

(21) Appl. No.: 14/646,069

(22) PCT Filed: Dec. 3, 2013

(86) PCT No.: PCT/EP2013/075344

§ 371 (c)(1),
(2) Date: May 20, 2015

(87) PCT Pub. No.: WO2014/090630

PCT Pub. Date: Jun. 19, 2014

(65) Prior Publication Data

US 2015/0300127 A1 Oct. 22, 2015

(30) Foreign Application Priority Data

Dec. 13, 2012 (EP) ..... 12197036

(51) Int. Cl.
*E21B 43/24* (2006.01)
*E21B 43/243* (2006.01)
(Continued)

(52) U.S. Cl.
CPC ..... *E21B 43/243* (2013.01); *E21B 37/00* (2013.01); *E21B 43/247* (2013.01)

(58) Field of Classification Search
CPC ..... E21B 43/248; E21B 43/263; E21B 29/02; E21B 43/116; E21B 43/117; E21B 37/00; E21B 43/243; E21B 43/247
See application file for complete search history.

(56) References Cited

U.S. PATENT DOCUMENTS 2,254,443 A 9/1941 Ostrom
3,422,760 A * 1/1969 Mohaupt ..... E21B 43/263 102/313

(Continued)

FOREIGN PATENT DOCUMENTS

EP 2 460 975 A2 6/2012
RU 2 062 194 C1 6/1996

(Continued)

OTHER PUBLICATIONS

International Search Report dated Feb. 6, 2014 in PCT/EP2013/075344 (with English language translation).

*Primary Examiner* — Brad Harcourt
(74) *Attorney, Agent, or Firm* — Grüneberg and Myers PLLC

(57) ABSTRACT

The invention relates to a heat generator for well stimulation, comprising a tubular fuel vessel (22) with two or more mutually separated, closed segments (23) arranged in longitudinal succession and each at least partly filled with fuel (30), and at least one igniter (40) for ignition of the fuel in at least one of the segments (23), wherein the ends of the segments are connected such that the fuel in a subsequent segment is ignitable owing to the evolution of heat in the course of burnoff of the fuel in a preceding segment. The invention further relates to a process for well stimulation using an inventive heat generator.

12 Claims, 4 Drawing Sheets

Figure 1C:
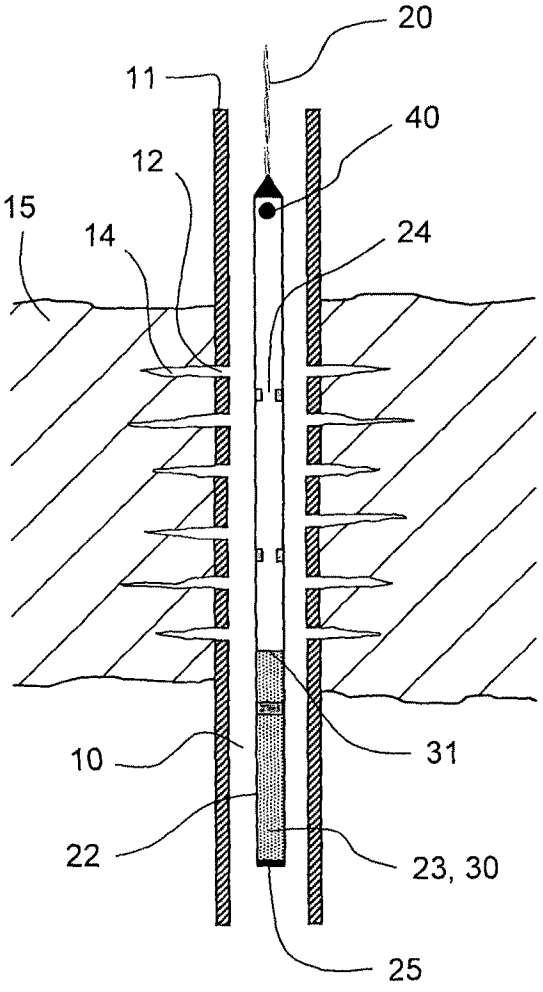

(51) Int. Cl.
*E21B 37/00* (2006.01)
*E21B 43/247* (2006.01)

(56) References Cited

U.S. PATENT DOCUMENTS

| | | | | |
|---|---|---|---|---|
| 3,520,364 | A | 7/1970 | Bauer | |
| 5,431,224 | A | 7/1995 | Laali | |
| 7,431,075 | B2 * | 10/2008 | Brooks | E21B 43/263 102/275.5 |
| 2008/0271894 | A1 | 11/2008 | Hill et al. | |

FOREIGN PATENT DOCUMENTS

| | | | |
|---|---|---|---|
| RU | 2291289 | C2 | 1/2007 |
| RU | 2 311 529 | C2 | 11/2007 |
| WO | WO 2012/150906 | A1 | 11/2012 |

* cited by examiner

DEVICE AND METHOD FOR WELL STIMULATION

The present invention relates to a heat generator for well stimulation, comprising a tubular fuel vessel with two or more mutually separated, closed segments arranged in longitudinal succession and each at least partly filled with fuel, and an igniter for ignition of the fuel in at least one of the segments. The invention further relates to a process for well stimulation using the inventive device.

In the production of fluids such as mineral oil or natural gas from underground rock strata, the productivity of a production system depends to a high degree on the permeability of the rock strata which adjoin the well. The more permeable these rock strata, the more economically a deposit can be operated. Both in the development and during production from a deposit, there may be a reduction in permeability and hence adverse effects.

In the production of wells, both for production and for injection wells, there may be slurrying of the porous rock layers during the drilling and cementing operation, such that the permeability falls. Moreover, there is a change in the stress, pressure and deformation state of the rock in the course of drilling, the result of which is that zones of elevated density and low permeability form in a circle around the well. During the operating phase of the well, paraffins, asphaltenes and high-viscosity tars are frequently deposited in the rock, these reducing the productivity of the well.

The best-known methods for counteracting a reduction in the permeability of the well region include various perforation technologies, vibration and heat treatment, the use of chemically active substances and swabbing. In one kind of perforation technology, gas generators which are operated with solid fuels are used. They are designed as encased or unencased explosive charges and, after detonation, generate hot gases which result in a pressure rise in the well and the adjacent rock strata. Typically, gas generators are used in the well at the level of the production zone in order to cause new perforations in the rock or widen existing perforations owing to the pressure rise.

Russian patent specification RU 2311529 C2 discloses a process for well stimulation by means of a gas generator in oil and gas production. The device includes tubular cylindrical explosive charges, detonation charges and a geophysical cable, called a logging cable, with securing elements for the explosive charges. The cable may be within a wound cable, such that the gas generator can also be used for angled, directed and horizontal wells. In the course of burnoff of the cylindrical explosive charges in the well, there is a thermal gas treatment and a compressed air treatment of the rock. If a perforation has been performed beforehand, the perforation channels are widened and cleaned, and fine cracks form in the rock. Under the action of high pressure from the gas generators, these processes are intensified. Under some circumstances, extended cracks may form. A disadvantage of this method is that the output gases spread rapidly in the well shaft and, as a result, the amount of energy available in the region of the well to be treated is relatively low.

The document US 2008/0271894 A1 discloses a device and a process for production of perforations in underground rock strata. Explosive charges are mounted around a support, and detonation of these generates perforations in the surrounding rock which expand as a result of increasing pressure. The device is provided with sealing elements which deform with rising pressure such that they adjoin the well wall and thus limit the space for pressure evolution.

Russian patent specification RU 2291289 C2 describes a device and a process for well stimulation. The device includes a tubular body in which fuel and an igniter are arranged. After ignition of the fuel, the temperature in the device rises very rapidly. Water present in the well around the device partly evaporates, which leads to pressure pulses. The steam which forms and the pressure waves cause generation or widening of perforations in the adjacent rock.

The document EP 2 460 975 A2 discloses a device for well stimulation in which a solid fuel is arranged on a rod or a rope between two limiting elements. The fuel takes the form of cylindrical charge units which have an axial recess through which the rod or the rope is passed. Specific embodiments disclose structural design elements such as sleeves or sealing packings which ensure that the steam which forms on burnoff of the fuel is guided specifically into the desired perforation region of the well.

The document WO 2012/150906 A1 discloses a pipe-shaped thermal pulse generator for well stimulation, in which fuel is located in an upper region of the pipe and is separated by a membrane from a lower, empty region. The lower region is provided with openings through which well fluid is able to flow into the interior of this region of the pipe. On burnoff of the fuel, the membrane is destroyed, and so hot burnoff residues such as slag fall into the lower region of the pipe and come into direct contact with the fluid. This intensifies the evolution of heat and the evaporation of the well fluid.

Even though several approaches for well stimulation are already known, there is still a need for improvement and enhanced efficiency in the production of mineral oil or natural gas from underground deposits.

It was an object of the present invention to provide a device and a process for well stimulation, by means of which the permeability of the rock around a region of the well can be improved in a controlled and efficient manner. At the same time, the device should be simple in terms of construction and be producible inexpensively.

This object is achieved by the subject matter of the invention as described in claim 1. Further advantageous embodiments of the invention can be found in the dependent claims. A further part of the subject matter of the invention is specified in process claim 11 and the claims dependent thereon.

According to the invention, the heat generator for well stimulation comprises a tubular fuel vessel with two or more mutually separated, closed segments arranged in longitudinal succession and each at least partly filled with fuel. The heat generator further comprises at least one igniter for ignition of the fuel in at least one of the segments. The ends of the segments are connected such that the fuel in a subsequent segment is ignitable owing to the evolution of heat in the course of burnoff of the fuel in a preceding segment.

The fuel vessel may have a one-piece or multipart design. The outer wall thereof is preferably manufactured from a material which withstands the pressure and temperature stresses during the burnoff of the fuel. The wall thickness is preferably selected such that the fuel vessel is not destroyed in the course of burnoff of the fuel. It depends on factors including the properties of the material from which the vessel is manufactured, and on the properties and the amount of the fuel used.

In a preferred configuration of the invention, the outer wall of the fuel vessel is manufactured from a steel, especially from a high-strength, ductile steel. Preference is further given to the use of pipes as typically used for production of oil or gas as fuel vessels. Such pipes are usually manufactured from steel with an internal diameter of 8 to 40 cm and a length of 1 to 15 m. The wall thickness thereof is typically 1 to 10 mm.

The inventive heat generator comprises at least one igniter for ignition of the fuel. The choice of igniter depends on the fuel used. For example, it is possible to use electrical igniters such as electrical light arc igniters or spiral igniters, or chemical igniters, provided that they have a sufficient activation energy.

Suitable chemical igniters are, for example, mixtures ignitable at temperatures below the ignition temperature of the fuel in the heat generator. Examples of suitable igniters are mixtures of (proportions by mass in percent in brackets):

$SiO_2$/Mg (55/45), $MnO_2$/Al dust/Al powder/Mg (68/7.5/7.5/17), $BaO_2$/Mg (88/12).

These mixtures are ignited with the aid of electrical pulses, for example with the abovementioned electrical igniters.

The electrical igniters are preferably activated by means of a conductive cable which is conducted along the logging cable or integrated within the logging cable from the surface of the well to the electrical igniter. A "logging cable" is understood here to mean a load-bearing cable on which the heat generator is secured and with the aid of which the heat generator can be lowered from the surface into the well.

In a preferred configuration of the inventive heat generator, the fuel vessel is configured as a one-piece pipe in which the segments are separated from one another by separating elements which extend over the entire pipe cross section within the pipe. The separating elements preferably run at right angles to the longitudinal axis of the fuel vessel. Particular preference is given to using, as separating elements, cylindrical structures of plastic or metal, the external diameter of which is slightly greater than the internal diameter of the pipe. The heat generator in this case can be produced for example, by first introducing fuel into the pipe and then forcing a separating element into the pipe, so as to form a closed segment. This operation is repeated until the envisaged number of segments with the desired amount of fuel is present.

In a first embodiment, the separating elements are configured such that they are not destroyed in the course of burnoff of the fuel. One configuration envisages that the separating elements are manufactured from a material whose melting point is above the temperature range which exists in the course of burnoff of the fuel. According to the fuel used, the burnoff in the interior of the heat generator can give rise to temperatures of well above 1000° C. Materials suitable for production of a separating element are, for example, steels, the alloy of which is selected such that the melting point thereof is higher than the highest temperature to be expected in the course of burnoff of the fuel. In another configuration, the separating elements are manufactured from a material whose melting point is below the temperature range which arises in the course of burnoff. In this case, the material thickness of the separating elements is such that the material begins to melt but does not completely melt through. The material thickness may, for example, be at least 2 cm to 5 cm in the case of a corresponding steel alloy with low melting point. In both configuration variants, the separating elements are not destroyed, but slow down the reaction front which migrates through the respective segment during the burnoff. The material and the dimensions of the separating elements are selected such that they provide heating up to a temperature range sufficient to activate the reaction in the next segment in each case.

In a second embodiment, the separating elements are manufactured from a material whose melting point is well below the temperature range which exists in the course of burnoff of the fuel. In this embodiment too, the separating elements slow down the reaction front which migrates through the respective segment during the burnoff. However, the separating elements are exposed to a temperature well above the melting point thereof owing to the high evolution of heat during the reaction. The respective separating element melts; the melt which forms in the course of burnoff of the fuel passes into the next segment and releases a sufficient amount of heat that the reaction therein is activated. Materials suitable for production of the separating elements for this embodiment are, for example, plastics having a melting temperature in the range from 150° C. to 500° C. or aluminum alloys having melting temperatures in the range from 600° C. to 800° C.

In a further preferred configuration of the inventive heat generator, the fuel vessel comprises two or more closed tubular vessels which form the segments and whose ends are connected via connecting elements.

The tubular vessels are filled at least partly, preferably completely, with fuel, and the ends thereof are closed, for example by closure elements such as blank flanges. The vessels may be connected at their ends via connecting elements in different ways. A method which can be implemented in a simple manner involves screw connection of the vessels by means of the connecting elements, for example by providing the vessels with an external thread onto which a tubular connecting element with an internal thread is screwed. A further means of connection is possible by providing each of the ends of the vessels to be connected with a flange as the connecting element, and connecting the flanges to one another, for example by screw connection. It is also easily possible to establish connections between the tubular vessels, for example, with swivel nuts or a bayonet mount.

One embodiment of the heat generator envisages that the ends are in contact and are manufactured from a material which ensures sufficient heat transfer for ignition of the fuel in the next segment. As well as a suitable material selection, the construction of the ends may also make a contribution to good heat transfer. Contact between the two ends over a large area is preferred in this respect. It is additionally preferable to execute the screw connections such that the adjacent end sides are firmly pressed against one another.

In a further embodiment of the heat generator, the vessel ends connected to one another are manufactured from a material whose melting point is below the temperature range which exists in the course of burnoff of the fuel. As in the embodiment with a one-piece pipe, the sequential ignition of the fuel is effected by melting the respective separating element and, in the next segment, releasing a sufficient amount of heat that the reaction therein is activated. The vessel ends may be closed on their end faces, for example, by closure elements in the form of caps or plugs manufactured from a plastic or an aluminum alloy. The melting temperature of the material used is preferably from 150° C. to 500° C. in the case of plastic, and from 600° C. to 800° C. in the case of the aluminum alloy. The axial extent of the caps or plugs is preferably from 5 mm to 50 mm. The closure elements ensure that the fuel can be stored and transported safely and with protection from environmental influences in the fuel vessel before it is burnt off when used in a well.

The longitudinal extent of the individual segments and the type and amount of the fuel in the respective segments influence the intensity and duration of the evolution of heat during the burnoff in a segment. In a preferred configuration, the longitudinal extents of the segments differ from one another by not more than 10%, especially not more than 1%. For this purpose, the distance between the separating elements or the length of the respective pipe sections is selected correspondingly. In one embodiment with separate closed pipe sections as segments, these pipe sections are preferably of equal length. With regard to efficient and inexpensive provision of inventive heat generators, prefabrication of segments with different lengths in the form of a building block system is advantageous. A suitable length division is intervals of 50 cm, beginning from segment lengths of one meter to five meters.

The longitudinal extents of the segments are more preferably selected such that they correspond to the axial extent of the well through the perforation region. In a further preferred configuration of the invention, the longitudinal extent of the heat generator over all segments is selected such that it corresponds overall to the axial extent of the well through the perforation region. The perforation region is understood here and hereinafter to mean the region of a production zone in which perforation holes and perforation channels are already present. Frequently, the axial extent of the perforation region corresponds to the thickness of the rock strata from which the fluid, for example mineral oil or natural gas, is to be produced.

The external diameter of the segments is preferably from 8 to 15 cm, especially from 10 to 12 cm. The diameter is advantageously selected such that it is 10% to 30% less than the internal diameter of the well in the region in which the heat generator is used. This has an advantageous effect on the efficiency of stimulation of the well.

The segments preferably have a circular cross section. However, the invention also covers other cross-sectional shapes, in which case the external diameter is understood as the greatest distance between two points on the cross-sectional area.

In an advantageous embodiment, spacers mounted on the outside of the heat generator have an extent in radial direction of at least 5 mm, especially at least 10 mm. Preferably, viewed in peripheral direction, at least three spacers are mounted, distributed over the circumference, such that the heat generator in each radical direction has a given minimum distance from the inner wall of the well. In axial direction, spacers are preferably arranged at a distance of 0.5 m to 3 m, such that the heat generator does not come into contact with the inner wall of the well over the entire length. The spacers may, for example, be configured as ribs or in the form of fingers. They are preferably manufactured from a material of similar thermal stability to the wall of the heat carrier and are fixed, for example welded, thereto.

In preferred configurations of the inventive heat generator, the fuel used is a metallothermic mixture. "Metallothermic mixtures" are understood here and hereinafter to mean mixtures of metals with metal oxides which, after activation of the redox reaction, are converted exothermically to form the metal originally present in the metal oxide. A preferred subgroup is formed by metallothermic mixtures in which aluminum is used as the reaction partner of the metal oxide. Such mixtures are referred to hereinafter as "aluminothermic". "Thermite" refers more particularly to a mixture of iron(III) oxide and aluminum, which is produced by and can be purchased from, for example, Elektro-Thermit GmbH & Co. KG (Halle/Saale).

The temperature range which arises in the course of the thermite reaction and the reaction enthalpy released can be adjusted by appropriate selection of the reaction partners and optionally the addition of additives. Patent specification RU 2291289 C2 discloses, as well as the abovementioned thermite mixtures, further metallothermic mixtures such as nickel(II) oxide and magnesium, iron(III) oxide and silicon, chromium(III) oxide and magnesium, molybdenum(VI) oxide and silicon and aluminum, vanadium(V) oxide and silicon. The burnoff of these mixtures may give rise to temperatures up to 2500° C. A further class of metallothermic mixtures including iron oxide, aluminum powder, alumina and a metal phosphate binder is known from document RU 2062194 C1. These mixtures have a comparatively low specific heat generation and a maximum burnoff temperature of about 1930° C.

A particularly suitable aluminothermic mixture for performance of the process according to the invention is one comprising aluminum as a reducing agent and CuO, FeO, $Fe_2O_3$, $Fe_3O_4$, $TiO_2$, $Cr_2O_3$ and/or $SiO_2$ as an oxidizing agent. Such aluminothermic mixtures are inexpensive compared to other metallothermic mixtures and cover a wide use range with regard to the ignition temperature, the maximum temperature which evolves in the course of burnoff of the fuel, and the burnoff rate.

In a further advantageous configuration, a metallothermic mixture which forms predominantly as a slag-like reaction product is used. In the case of aluminothermic mixtures, these are also referred to as "incandescent thermite". Such mixtures comprise, as well as the reaction partners required for the redox reaction, further components which attenuate the reaction. Although the mixture reacts completely with corresponding release of heat, the metal melt which forms solidifies very rapidly, such that there is no macroscopic material flow. The reaction product is present in the form of a metal-slag foam. These mixtures offer advantages especially when the reaction volume is to remain essentially constant, for example in order to establish a substantially constant outside temperature of the fuel vessel over a particular length of a segment.

In a further advantageous configuration, different fuels are arranged in one segment. Particular preference is given to an embodiment in which a metallothermic mixture is arranged in an upper region of the segment, the reaction of which gives rise predominantly to a slag-like reaction product, especially incandescent thermite, while the lower region of the segment is filled with a metallothermic mixture, the reaction of which gives rise predominantly to a liquid reaction product, especially what is called pure thermite. "Pure thermite" refers to aluminothermic mixtures which comprise only the metal oxide and aluminum without addition of steel formers such as carbon or ferromanganese. The reaction products which form in the course of burnoff of these mixtures are liquid metal and aluminum slag. Most preferably, the metallothermic mixture whose reaction gives rise predominantly to a slag-like reaction product takes up a proportion of 50% to 80% of the internal volume of the segment in question. Particular preference is given, in this embodiment, to using incandescent thermite with a further aluminothermic mixture, especially pure thermite. In this configuration of the invention, the reaction forms both solid slag-like products and liquid metal which can serve, for example, to melt the separating elements or the closure elements and thus to transport heat of reaction into a next segment. At the same time, a very substantially homogeneous temperature range over a particular length of the fuel vessel is ensured.

The fuel may be present in different forms in the segments, for example as a solid body, pasty mass or fine bulk material. The solid body may be produced, for example, by pressing with or without binder.

The heat generator can be manufactured beforehand in individual parts and be transported to the well, for example individual pipe sections filled with fuel. On site, the individual components can be assembled in a simple manner and matched to the specific requirements, for example by screwing an appropriate number of pipe sections together as required. Lengths of individual pipe sections of one to three meters are preferred from a manufacturing point of view and with regard to simple transport to the well. The total length of the heat generator depends on the respective demands and may, for example, be from two to twenty meters. The heat generator can be introduced into the well and withdrawn therefrom again by known means such as a hoist and logging cable.

The invention further comprises a process for well stimulation in which an inventive heat generator is introduced into a well and positioned such that the uppermost segment is at the level of the perforation region of the well, then the fuel in the uppermost segment is ignited and, after the ignition of the fuel, the heat generator is pulled upward and positioned such that the segment in the process of burnoff is at the level of the perforation region of the well.

Owing to the evolution of heat by the burnoff of the fuel, the well fluid which surrounds the heat carrier in the region of the segment in the process of burnoff is strongly heated, preferably within temperature ranges of the boiling point thereof. The hot liquid and the steam which arises cleans the perforation region adjoining the well.

In a preferred variant of the process according to the invention, the heat generator is pulled upward continuously at a speed corresponding to the speed of the reaction front in the segment in the process of burnoff.

In a further preferred variant of the process according to the invention, the heat generator, after the fuel has been ignited in the next segment in each case, is pulled upwards stepwise by the length of the segment in the process of burnoff.

The process according to the invention for well stimulation is notable in that the total duration of pressure generation and stimulation of the rock is increased compared to known processes. Moreover, the arrangement of the fuel in segments and the sequential ignition of the segments results in generation of intermittent steam and water pressure waves in the well. During the burnoff in a segment, a high pressure and a high temperature exist in the region of the perforation orifices in the production zone. After extinguishment of the reaction until the ignition of the reaction in the next segment, pressure and temperature in the production zone decline again. This has a beneficial effect on the cleaning and stimulation of the perforation orifices. Appropriate selection of the design parameters for the heat generator allows the duration and intensity of the intervals to be adjusted individually. Design parameters are, for example, the number and length of the segments, the nature and amount of the fuels in the respective segments and the materials of the fuel vessel, or of the separating elements or closure elements.

The inventive heat generator is notable for a simple construction which is inexpensive to produce and easy to employ. The heat generator can be manufactured ahead of time, optionally in individual parts, and stored over a prolonged period without any problems. More particularly, in the case of use of an aluminothermic mixture as the fuel, no potentially harmful gases escape in the course of burnoff of the fuel.

Figure 1B:
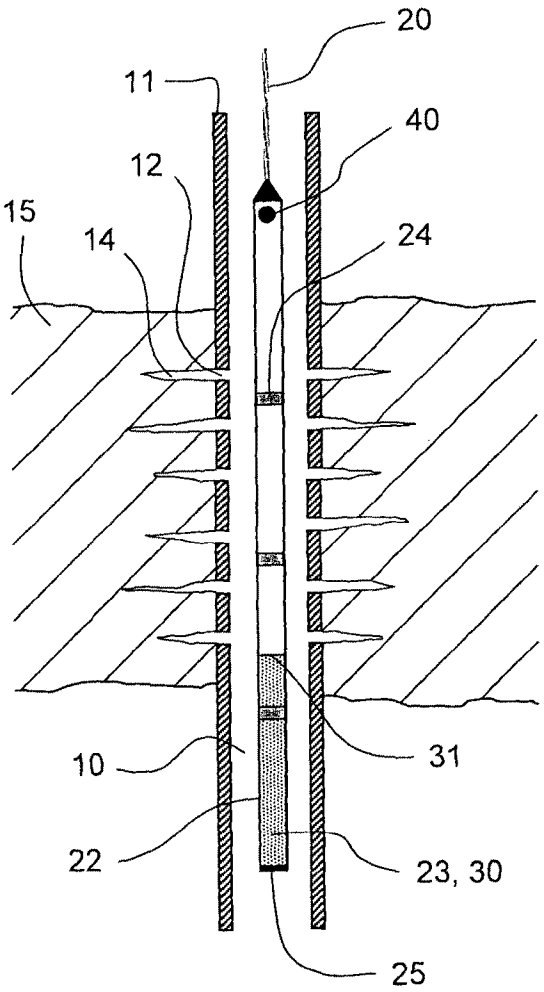
Figure 1A:
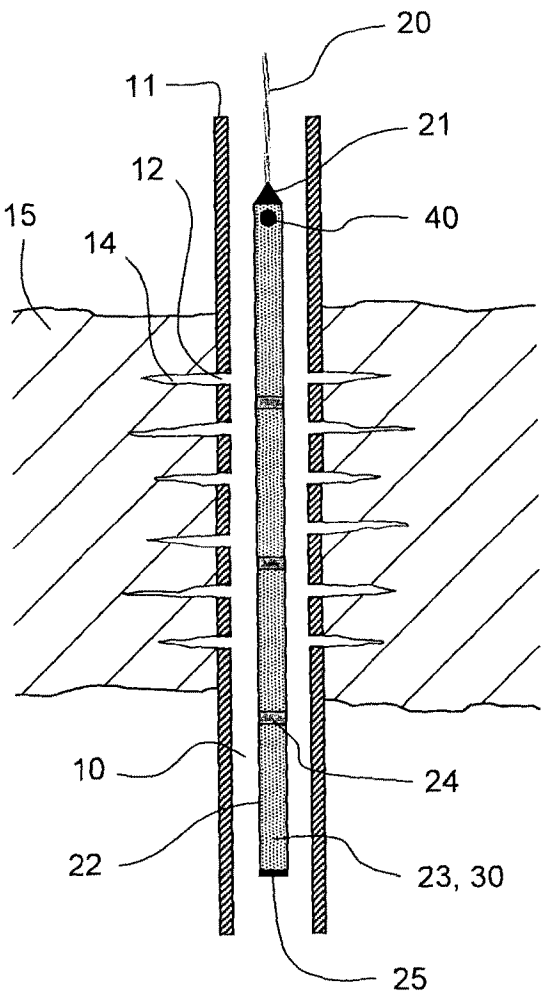
Figures 2A, 2B, 2C:
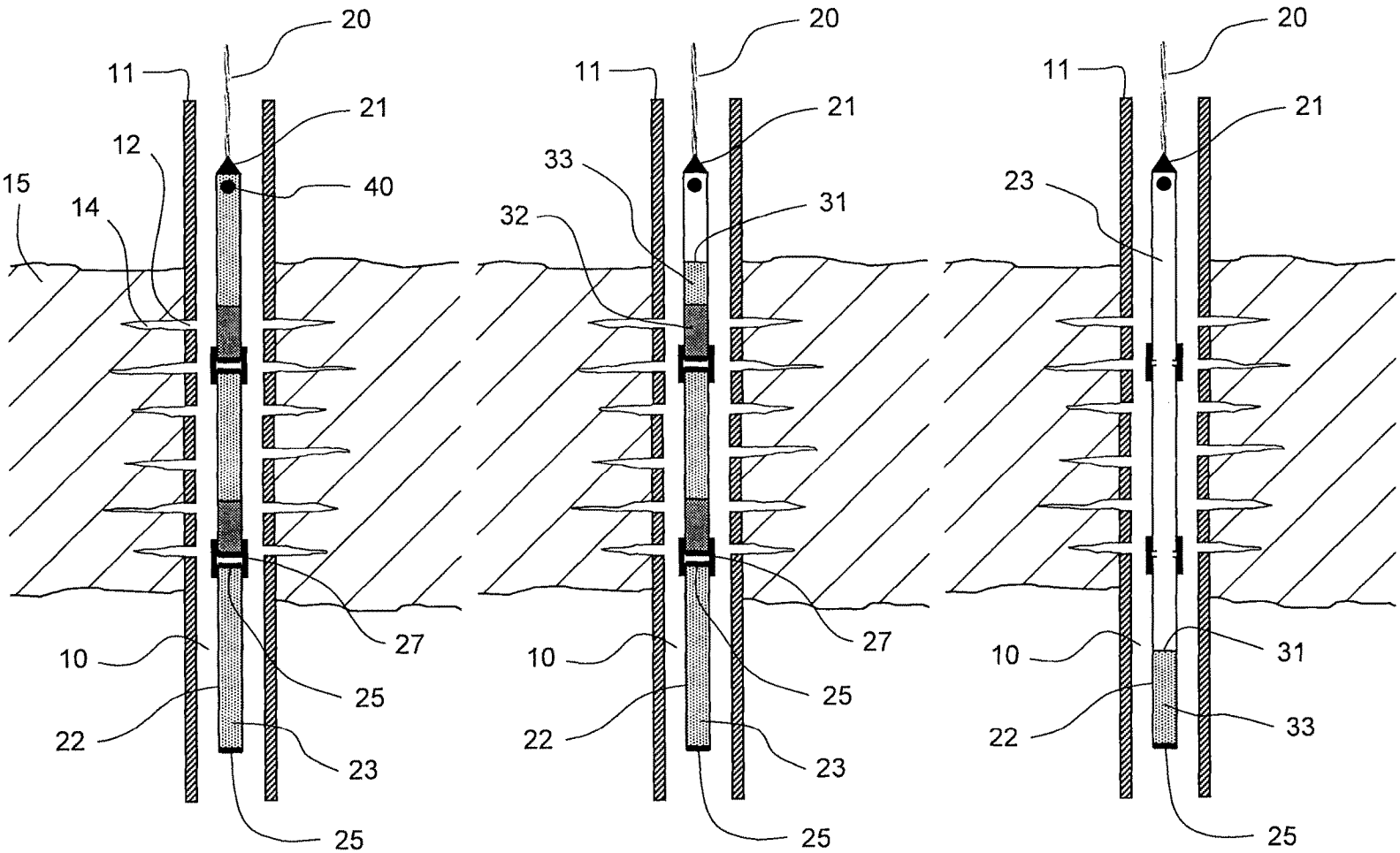
Figure 3:
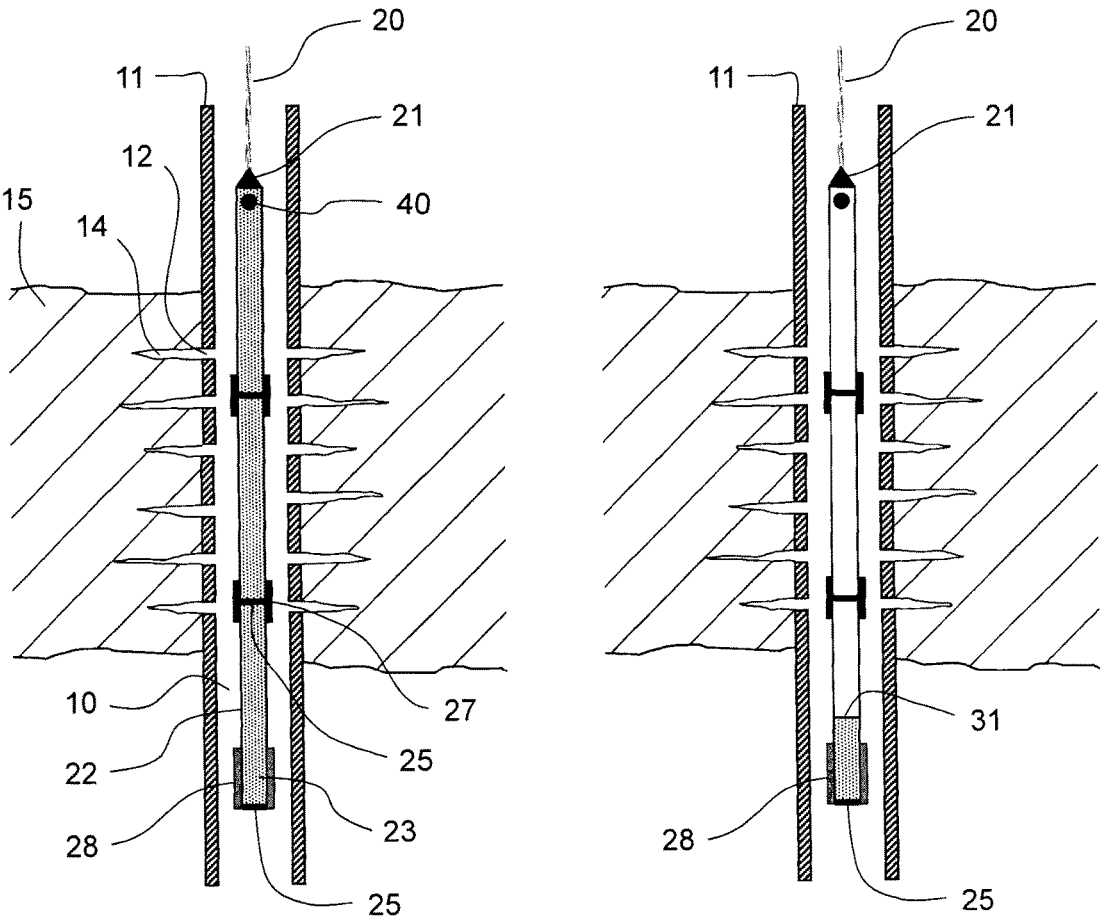
Figures 4A, 4B, 4C:
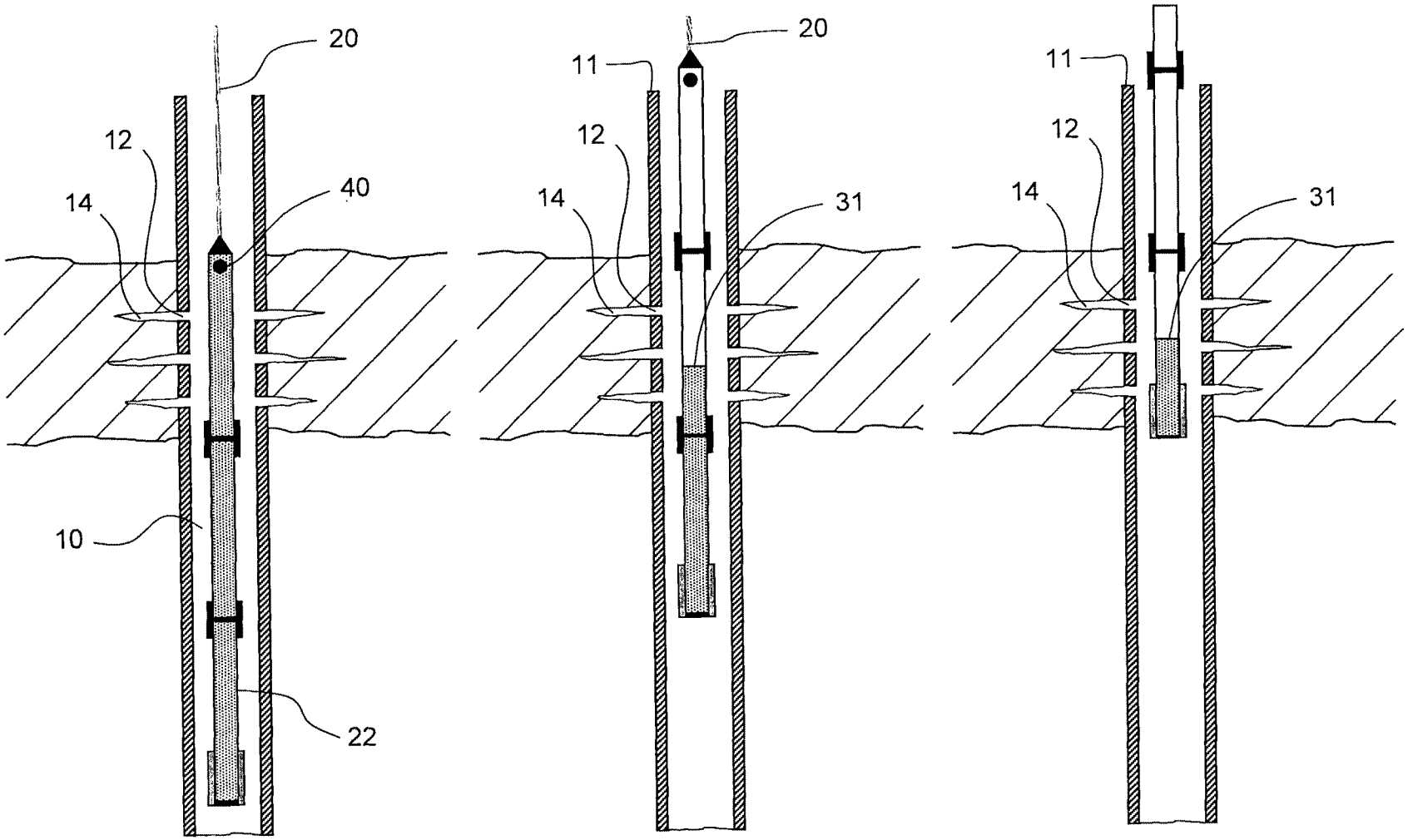

The drawings are used hereinafter for further illustration of the invention, though the drawings should be understood as schematic diagrams. They do not constitute any restriction of the invention, for example with respect to specific dimensions or configuration variants of components. For the sake of better illustration, they are generally not to scale, particularly with regard to length and width ratios. The figures show:

FIGS. 1*a*, 1*b* and 1*c*: a first embodiment of an inventive heat generator FIGS. 2*a*, 2*b* and 2*c*: a second embodiment of an inventive heat generator FIG. 3: a third embodiment of an inventive heat generator FIGS. 4*a*-4*b* and 4*c*: variants of a process according to the invention for well stimulation

LIST OF REFERENCE NUMERALS USED

10 . . . Well
11 . . . Lining
12 . . . Perforation orifices
14 . . . Perforation channels
15 . . . Production zone
20 . . . Logging cable
21 . . . Suspension system for the fuel vessel
22 . . . Fuel vessel
23 . . . Segment
24 . . . Separating element
25 . . . Closure element
26 . . . Vessel
27 . . . Connecting element
28 . . . Pipe shell
30 . . . Fuel
31 . . . Reaction front
32 . . . "Pure thermite"
33 . . . "Incandescent thermite"
40 . . . Igniter FIGS. 1*a*, 1*b*, 1*c*, 2*a*, 2*b*, 2*c*, 3, 4*a*, 4*b* and 4*c* are schematic section drawings of a well 10 in an underground deposit. The well 10 is provided with a lining 11, for example a steel pipe. The lining 11 prevents loose rock adjoining the well from falling into the well, and formation fluids typically under pressure, such as formation water, from breaking through into the well in large volumes. The lining 11 has several perforation orifices 12. Known processes such as ball perforation or jet perforation were used to generate perforation channels 14 in the production zone 15. Fluids to be produced, for example natural gas or mineral oil, flow via the perforation channels 14 through the perforation orifices 12 into the well and can be produced to the surface.

The inner wall of the lining 11 has a cylindrical or stepwise cylindrical configuration with a circular cross section. In the case of a stepwise cylindrical configuration, the diameter of the circular cross section decreases stepwise in the axial downward direction. The fuel vessel 22 of the heat generator is connected via a suspension system 21 to the logging cable 20, which can be moved by means of a hoist at the surface. The latter is not shown in the figures; corresponding devices are known to those skilled in the art.

FIGS. 1*a*, 1*b* and 1*c* show a first preferred embodiment of an inventive heat generator. A tubular fuel vessel 22 is secured on a logging cable 20 by means of a suspension system 21. The fuel vessel 22 takes the form of a one-piece pipe bounded at the top and bottom by a closure element 25. In the interior, in the example shown, there are three separating elements 24 which divide the interior into four segments 23. The separating elements 24 extend over the entire pipe cross section, such that each of the segments 23 is closed. The segments are filled completely with fuel 30, in this example an aluminothermic mixture comprising the components Al, FeO, $Fe_2O_3$, $Fe_3O_4$ and $SiO_2$.

In the uppermost segment is mounted an igniter 40 suitable for igniting the fuel in this segment, for example an electrical igniter such as a light arc igniter or spiral igniter, or a chemical igniter which is suitable on the basis of its composition for igniting the aluminothermic mixture.

The heat generator in the well 10 is positioned in the region of the perforation orifices 12 in the production zone 15. In order to start the well stimulation, the reaction in the uppermost segment is activated by means of the igniter 40. The activation or ignition temperature depends on the composition of the aluminothermic mixture and may be from 600° C. to 1300° C. The strongly exothermic reaction commences in the environment of the igniter 40 in the uppermost segment. After the initial ignition, the reaction moves, depending on the specific mixture, downward at a rate of about one centimeter to one meter per second. This may give rise to liquid metal, for example liquid iron in the case of the conventional thermite reaction comprising Al and $Fe_2O_3$ or Al and $Fe_3O_4$ as reaction partners. In the case of use of incandescent thermite, solid slag-like products are formed.

Commercial thermite mixtures comprise, as components, aluminum powder and iron oxide of a low oxidation state. One example is a mixture of 76% by weight of $Fe_3O_4$ and 24% by weight of Al, which reacts to give 45% by weight of $Al_2O_3$ and 55% by weight of elemental iron with release of heat. The reaction products have only a low flow capacity and solidify rapidly. The density of the thermite mixture is approx. 2 $t/m^3$.

The heat of reaction released strongly heats the pipe wall of the fuel vessel 22 and the separating elements 24. The middle diagram (FIG. 1*b*) shows an embodiment of the invention in which the separating elements 24 are manufactured from a material whose melting point is above the temperature range which exists in the course of burnoff of the fuel. The separating elements 24 are not destroyed by the thermite reaction, but slow down the reaction front 31. However, they are heated up to a temperature range sufficient to activate the thermite reaction in the next segment. Thus, the reaction front 31 migrates from the top downward through the fuel vessel 22 until all fuel 30 has been used up.

The right-hand figure (FIG. 1*c*) shows a further embodiment of the invention, in which the separating elements 24 are manufactured from a material whose melting point is below the temperature range which exists in the course of burnoff of the fuel. The reaction in this case too is activated by the igniter 40 and continues at first in the uppermost segment, migrating downward. As soon as the reaction front 31 reaches the first separating element, the reaction is extinguished since all fuel has been consumed. However, the separating element, owing to the high evolution of heat, is exposed during the reaction to a temperature above its melting point. In the case of a reaction, for example, in which liquid metal is formed, the liquid metal collects above the separating element and is in direct contact therewith. The separating element melts and releases a sufficient amount of heat in the next segment that the reaction therein is activated, for example by liquid metal flowing in. As in the example of indirect heat transfer, the reaction in this case too continues from segment to segment until the lower end of the fuel vessel 22 has been reached. The closure element 25 at the lower end of the fuel vessel 22 is preferably manufactured from a material whose melting point is above the temperature range which exists in the course of burnoff of the fuel. This ensures that the reaction products of the thermite reaction do not get into the well.

The fuel vessel 22 may be produced from a steel pipe as typically used in mineral oil production and referred to a "tubing", for example of the H-40, C-75, N-80 or P-105 type. The closure element 25 and the nonmelting separating elements 24 in the case of the embodiment according to FIG. 1*b* may be manufactured from the same steel. For the separating elements 24 of the embodiment according to FIG. 1*c*, which are destroyed in the course of burnoff of the fuel, materials such as plastic, aluminum or an iron alloy with a low melting point are suitable.

FIGS. 2*a*, 2*b* and 2*c* show a further preferred embodiment of the inventive heat generator. A tubular fuel vessel 22 is secured to a logging cable 20 by means of a suspension system 21. The fuel vessel 22 is composed of three closed tubular vessels which form three segments 23 of the fuel vessel 22. The vessels are bonded to one another, for example screwed together, at their ends by means of connecting elements 27. The segments are filled completely with fuel 30, in this example an aluminothermic mixture comprising the components Al, FeO, $Fe_2O_3$, $Fe_3O_4$ and $SiO_2$.

In the uppermost segment, an igniter 40 is provided, this being suitable for igniting the fuel in this segment, for example an electrical igniter.

The tubular vessels are closed at their ends with closure elements 25. The adjoining closure elements 25 of adjacent segments are manufactured from a material whose melting point is below the temperature range which exists in the course of burnoff of the fuel, for example from a suitably selected plastic or metal.

The heat generator in the well 10 is positioned in the region of the perforation orifices 12 in the production zone 15. In order to start the well stimulation, the igniter 40 is used to activate the reaction in the uppermost segment. The strongly exothermic thermite reaction commences in the environment of the igniter 40 in the uppermost segment. After the initial ignition, the reaction moves, depending on the specific mixture, downward at a rate of about one centimeter to one meter per second. This can form liquid metal, for example liquid iron, in the conventional thermite reaction.

As soon as the reaction front 31 reaches the lower closure element 25 of the first segment, the reaction in this segment is extinguished, since all fuel has been consumed. However, the closure element, due to the high evolution of heat during the reaction, is exposed to a temperature above its melting point. In the case of a reaction, for example, in which liquid metal is formed, the liquid metal collects above the closure element and is in direct contact therewith. The closure element melts and allows liquid metal to flow onto the upper closure element of the next segment. This closure element too melts and allows liquid metal to penetrate into the interior of the vessel. This releases a sufficient amount of heat that the reaction in this segment is activated. The reaction front 31 migrates in this way through all segments until the lower end of the vessel 22 has been reached. In order to activate the reactions in the next segments in each case, it is not necessary for the closure elements 25 to melt completely. It is sufficient when a hole through which the hot liquid metal can flow downward is melted. The closure element 25 at the lower end of the fuel vessel 22 is preferably manufactured from a material whose melting point is above the temperature range which exists in the course of burnoff of the fuel. This ensures that the reaction products of the thermite reaction do not get into the well.

The individual tubular vessels may be filled with different fuels. In a preferred configuration, the vessel which forms the lowermost segment is completely filled with incandescent thermite 33. The vessels above are likewise filled with incandescent thermite 33 in the upper part of each, while the lower part of each is filled with a thermite mixture 32, the burnoff of which gives rise to predominantly liquid reaction products, especially pure thermite.

The incandescent thermite 33 preferably takes up a proportion of 50% to 80% of the total internal volume of the vessel. The remaining 50% to 20% of the internal volume is filled with the thermite mixture, the burnoff of which gives rise to predominantly liquid reaction products. In this configuration of the invention, the reaction in the interior of the fuel vessel forms both solid slag-like products and liquid metal which serves to melt the closure elements and thus for transport of heat of reaction into the next segment. The proportion of incandescent thermite in the internal volume is preferably matched to the properties of the closure elements. The higher the melting point thereof, the smaller the proportion of incandescent thermite that will be selected. If the closure elements, for example, are manufactured from a low-melting plastic, the proportion of incandescent thermite may be up to 80%. In the case of closure elements made from a higher-melting aluminum alloy, for example, the proportion of incandescent thermite should be in the region of 50%.

FIG. 3 shows a further embodiment of an inventive heat generator. As in the embodiment according to FIGS. 2*a*, 2*b* and 2*c*, the fuel vessel 22 comprises three closed, tubular vessels which form three segments 23 of the fuel vessel 22. The vessels are connected to one another, for example screwed together, at their ends by means of connecting elements 27. The closure elements 25 at the ends of the respective vessels are manufactured from a material whose melting point is above the temperature range which exists in the course of burnoff of the fuel. In this embodiment, the vessels are of such a composition that the respective closure elements 25 of adjacent segments 23 are in contact. The reaction in the next segment in each case is activated by heat transfer via the closure elements 25 of the vessels.

In order to further minimize the escape of liquid metal or other reaction products, an additional pipe jacket 28 is provided at the lowermost end of the fuel vessel 22, this being manufactured from a material whose melting point is above the temperature range which exists in the course of burnoff of the fuel. This measure can of course also be taken in the case of all other embodiments.

As well as the advantages already mentioned, the embodiments according to FIGS. 2*a*, 2*b*, 2*c* and 3 also have the advantage that, owing to their modular structure, they can be matched flexibly to the respective circumstances in a specific well. For example, the length of the fuel vessel can be matched without any problem to the respective geological conditions. It is also possible to realize fuel vessels having a total length of more than 20 meters without any problem through the modular construction.

FIGS. 4*a*, 4*b* and 4*c* illustrate an embodiment of the process according to the invention for well stimulation. An inventive heat generator, in this example a heat generator according to FIG. 3, is introduced into a well 10 and positioned such that the uppermost segment is at the level of the perforation region of the well. The thickness of the perforation zone, shown hatched in FIGS. 4*a*, 4*b* and 4*c*, is about three meters in this example. The lengths of the tubular vessels 23 are matched to the perforation zone and are each three meters. The design parameters for the heat generator are selected such that the burnoff time per segment is about two minutes, and there is a transition time for ignition of the fuel in the next segment of about one minute.

After the ignition of the fuel in the uppermost segment, the heat generator is pulled upward and positioned such that the segment in the process of burnoff is at the height of the perforation region of the well. In one variant of the process according to the invention, the heat generator is pulled continuously upward at a rate corresponding to the speed of the reaction front 31 in the segment in the process of burnoff. The term "continuously" is also understood to mean a stepwise movement, for example at intervals of seconds or minutes.

In a further variant of the process according to the invention, the heat generator, after ignition of the fuel in the next segment in each case, is pulled upward stepwise by the length of the segment in the process of burnoff, in the example by three meters. This can achieve the effect that the well outside the perforation region is not affected in terms of pressure and temperature stress, and the perforation region is treated optimally with pressure and temperature intervals.

The invention claimed is:

1. A heat generator, comprising:

a tubular fuel vessel with two or more mutually separated, closed segments arranged in longitudinal succession and each at least partly filled with fuel, and at least one igniter configured for ignition of the fuel in at least one of the segments, wherein the fuel vessel comprises two or more closed tubular vessels which form the segments and whose ends are connected via connecting elements, or the fuel vessel is configured as a one-piece pipe in which the segments are separated from one another by separating elements which extend over an entire pipe cross section within the pipe, so that the fuel in a subsequent segment is ignitable owing to evolution of heat in the course of burnoff of the fuel in a preceding segment;

wherein the fuel vessel is configured as a one-piece pipe in which the segments are separated from one another by separating elements which extend over the entire pipe cross section within the pipe, and the separating elements are manufactured from a material whose melting point is below a temperature range which exists in the course of burnoff of the fuel.

2. The heat generator according to claim 1, wherein the fuel vessel comprises two or more closed tubular vessels which form the segments and whose ends are connected via connecting elements, and wherein the ends are in contact and are manufactured from a material which ensures sufficient heat transfer for ignition of the fuel in the next segment.

3. The heat generator according to claim 2, wherein the mutually connected vessel ends are manufactured from a material whose melting point is below a temperature range which exists in the course of burnoff of the fuel.

4. The heat generator according to claim 1, wherein longitudinal extents of the segments differ from one another by not more than 10%.

5. The heat generator according to claim 1, wherein longitudinal extents of the segments are such that they correspond to an axial extent of a well through a perforation region.

6. The heat generator according to claim 1, wherein a longitudinal extent of the heat generator over all segments is such that it corresponds to an axial extent of a well through a perforation region.

7. The heat generator according to claim 1, wherein the fuel is a metallothermic mixture.

8. The heat generator according to claim 7, wherein the fuel comprises aluminum as a reducing agent and CuO, FeO, $FeO_3$, $Fe_3O_4$, $Cr_2O_3$ and/or $SiO_2$ as an oxidizing agent.

9. The heat generator according to claim 7, wherein a first metallothermic mixture is arranged in an upper region of a segment, the reaction of which gives rise predominantly to a slag-like reaction product, and the lower region of the segment is filled with a second metallothermic mixture, the reaction of which gives rise predominantly to a liquid reaction product.

10. A process for well stimulation, comprising:

introducing the heat generator according to claim 1 into a well such that the uppermost segment is at a level of a perforation region of the well, then igniting fuel in the uppermost segment wherein, after the ignition of the fuel, the heat generator is pulled upward and positioned such that a segment in the process of burnoff is at the level of the perforation region of the well.

11. The process according to claim 10, wherein the heat generator is pulled upward continuously at a speed corresponding to a speed of the reaction front in the segment in the process of burnoff.

12. The process according to claim 10, wherein the heat generator, after the fuel has been ignited in the next segment in each case, is pulled upward stepwise by a length of the segment in the process of burnoff.

* * * * *